US005113922A

United States Patent [19]

Christensen et al.

[11] Patent Number: 5,113,922

[45] Date of Patent: May 19, 1992

[54] VENETIAN BLIND ASSEMBLY FOR A WINDOW IN AN INCLINED ROOF

[75] Inventors: Per B. Christensen, Puerto Del Carmen, Spain; Svend A. Sonderby, Videb, Denmark

[73] Assignee: V. Kann Rasmussen Industri A/S, Soborg, Denmark

[21] Appl. No.: 634,138

[22] PCT Filed: Aug. 4, 1989

[86] PCT No.: PCT/DK89/00186

§ 371 Date: Jan. 10, 1991

§ 102(e) Date: Jan. 10, 1991

[87] PCT Pub. No.: WO90/01608

PCT Pub. Date: Feb. 22, 1990

[30] Foreign Application Priority Data

Aug. 5, 1988 [DK] Denmark ..... 4412/88

[51] Int. Cl.[5] ..... E06B 9/30

[52] U.S. Cl. ..... 160/172; 160/192; 160/107; 160/265

[58] Field of Search ..... 160/172, 189, 192, 191, 160/107, 313, 314, 84.1, 265

[56] References Cited

U.S. PATENT DOCUMENTS 794,937 7/1905 Hopkins .
4,552,196 11/1985 Vecchiarelli .
4,744,403 5/1988 Hausmann et al. .

FOREIGN PATENT DOCUMENTS 1683026 12/1969 Fed. Rep. of Germany .
1683092 12/1974 Fed. Rep. of Germany .
2906871 9/1980 Fed. Rep. of Germany .

*Primary Examiner*—Blair M. Johnson
*Attorney, Agent, or Firm*—Lane, Aitken & McCann

[57] ABSTRACT

A Venetian blind for inside installation in a window in an inclined roof comprises profile lists fastened to the side pieces of the sash for guiding at least the lower list of the shade, whereby a load acting on the lower list of the Venetian blind to pull it towards its lowered position, is provided by at least one coil spring. The coiled part of the spring is seated in a housing at one end of the lower list with its axis of rotation essentially parallel to the longitudinal axis of the lower list, and the uncoiled part runs in one of the profile lists and is fastened at the lower end of this list near the lower edge of the window.

2 Claims, 1 Drawing Sheet

FIG. 1
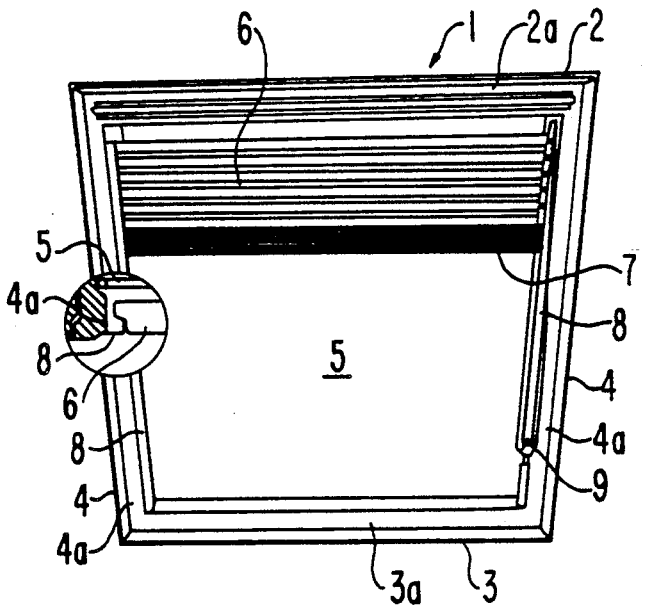
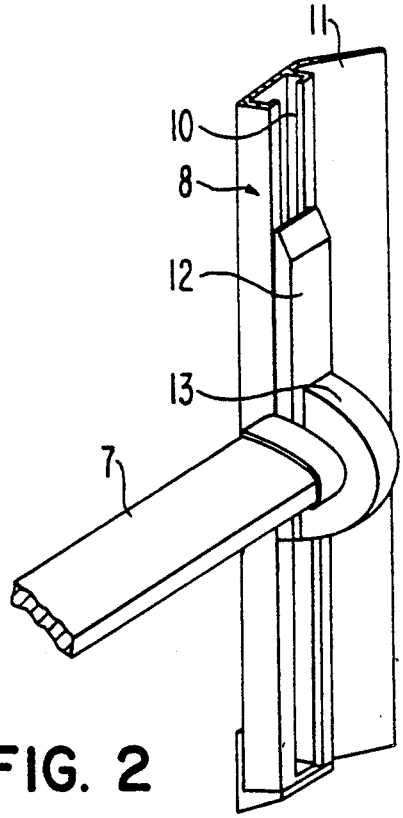
FIG. 2
FIG. 3
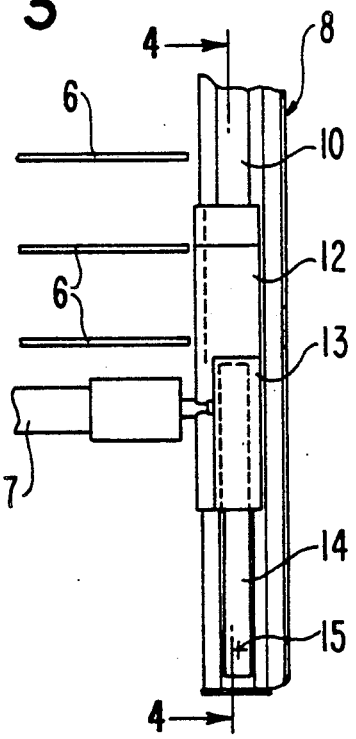
FIG. 4
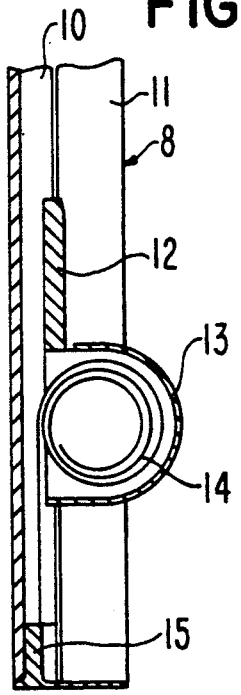

VENETIAN BLIND ASSEMBLY FOR A WINDOW IN AN INCLINED ROOF

The invention relates to a Venetian blind or similar shade for installation on a window in an inclined roof said window comprising a sash having side parts extending in the direction of the roof inclination, in which side parts tracks are provided for guiding a lower list of the shade, at its raising and lowering in proportion to the sash, the lower list being loaded in the direction of the lowering by at least one coil spring rotatably seated in a housing, an uncoiled part of the spring extending from one end of the lower list downwards in the track to a lower fixing point.

It is generally known to use Venetian blinds and similar shades e.g. roller blinds, folding blinds and roller shades for windows in an inclined roof but at low roof inclination, i.e. under approximately 20°, it is not possible to bring the lower list of the shade to its lowest position (lowered shade) without using auxiliary devices, because the friction between the side parts and partly slide shoes, by means of which the lower list is guided during the lowering, partly the shade itself such as the slats of a Venetian blind, becomes too high in proportion to the component of the gravity pull in the direction of lowering. Well-known devices are e.g. cords or spindles, but they are not very stable in their function.

From DE-Al-29 06 871 a roller shutter is known using coil springs to ensure the lowering. The roller shutter which is intended for outside installation, comprises a heavy frame with tracks opening towards the middle of the window for guiding the lower list of the shutter and at the bottom of the sash a coil spring is seated at each of the two corners, the axis of rotation of which is perpendicular to the plane of the shutter. The uncoiled parts of these springs are carried upwards in the guiding tracks and are fastened to the ends of the lower list whereby exerting a pull on the lower list and thus on the roller shutter against its lowered position. The arrangement with a heavy frame to hide the spring is not, however, suitable for installation on the inner side of a window, as it is too unwieldy and would reduce the effective light area of the window.

Further a roller blind for inside installation is known from U.S. Pat. No. 794.937 comprising a hollow lower list, in the middle of which a rotatable drum is seated with its axis of rotation oriented horizontally and perpendicular to the longitudinal direction of a lower list. On the drum two cords or bands are wound one above the other, e.g. steel bands, each of them extending from the drum to its own end of the lower list, from where it is guided downwards over guide rollers through the respective guiding track and fastened with its free end at bottom of the track. The drum is loaded in the direction of winding by a coil spring whereby, through the cords or bands, the lower list is permanently affected in the direction of lowering. The aim is to balance the effect of the spring on the rollers in the blind, so that the roller blind can remain in any desired position. In this construction the lower list must necessarily have a large cross section making it look clumsy and reducing the effective light area of the window, when the shade is raised.

The shade according to the invention differs from the above prior art in that at least one of the guiding tracks is formed in a profile list designed for installation on the inner side of the side part of the sash with the opening of the truck facing the outer side of the window, the housing of the coil spring being slidable in the track and connected to the proper end of the lower list and the axis of the coiled part of the spring seated in the housing being parallel to the longitudinal direction of the lower list.

By means of the invention several advantages are obtained compared to the prior art according to the above mentioned patents. The axis of rotation of the coil spring being parallel to the longitudinal direction of the lower list thus causing the spring to be turned upright, the profile list fixed on the side part of the sash of the window can be made as narrow as possible so as to take away a minimum amount of light when the shade is raised and still the coil spring with its housing will hardly be noticeable from the inside, as it is practically hidden by the profile list.

Below the invention will be explained in further detail by means of an embodiment with reference to the drawing on which:

FIG. 1 shows a window in an inclined roof with a partly lowered Venetian blind according to the invention seen from the inside, FIG. 2 a perspective view of a piece of a profile list with a slide shoe with a housing for a coil spring and the end of the lower list of a Venetian blind seated in the housing, FIG. 3 a plane view corresponding to FIG. 2, and FIG. 4 a section along line 4—4 in FIG. 3.

In FIG. 1 a window in an inclined roof 1 is shown having a frame comprising a top part 2, a lower part 3 and side parts 4, and a sash with corresponding sash parts 2*a*, 3*a* and 4*a* framing a pane 5. Inside the pane 5 a venetian blind with slats 6 and a lower list 7 are installed, being guided by profile lists 8, which are fitted on the side parts 4*a* of the sash. The slats 6 are also guided by the profile list 8 by virtue of cutouts in their ends as shown in a circle in FIG. 1. The Venetian blind is operated by means of a cord drive 9.

As shown in FIG. 2 each profile list 8 has a track 10, which faces the pane 5, when the list by means of a flange 1 is fitted on the side part 4*a*. Along the track 10 and engaged with it, a slide shoe 12 runs, on which a housing 13 is placed accommodating a coil spring 14. This is seen in FIG. 3 and 4, which also show how the coiled part of the coil spring is placed in the housing 13, while its uncoiled part extends along the track 10 at the bottom and is fastened to the lower part 15 of the profile list 8.

In FIG. 2 and 3 it is further shown, how the end of the lower list of the Venetian blind is seated in the housing 13.

When the Venetian blind is raised only the profile lists 8 and the raised blind at the top of the window will be seen. The slide shoes 12 with the spring housings 13 are hidden behind the profile lists and partly behind the lower list 7 when the window is viewed obliquely from the side. Thus the spring housings 13 will hardly be noticeable.

By virtue of the special spring characteristic of the coil springs the Venetian blind will be affected by a constant force against its lowered position irrespective of its actual position. The spring force can be adjusted so that the venetian blind will always stay in the position to which it is adjusted, even if the window is tilted to vertical position with its lower part upwards.

We claim:

1. A shade arrangement for installation on a window in an inclined roof (1), said window comprising a sash (2*a*; 3*a*; 4*a*) having side parts extending in the direction of the roof inclination, said shade arrangement comprising a shade defining a plane and including when installed, inclined profile lists (8) mounted on the inner side of said parts (4*a*), said profile lists (8) having slotted tracks (10), at least one of which opens transversely to said plane, said tracks (10) engaging and guiding lower list (7) of the shade at its inclined raising and lowering, the lower list (7) being loaded in the direction of the lowering by at least one coil spring (14) rotatably seated in a housing (13), said housing (13) being slidable in the transversely opening track (10) and connected to the lower list (7), an uncoiled part of the spring extending from the housing (13) in the track (10) downwards to a lower fixing point (15), and the axis of the coiled part of the spring (14) seated in the housing being parallel to the longitudinal direction of the lower list.

2. A shade arrangement for installation on a window in an inclined roof (1), said window comprising a sash (2*a*; 3*a*; 4*a*) having side parts extending in the direction of the roof inclination, said shade arrangement comprising a shade defining a plane and including when installed inclined profile lists (8) mounted on said parts (4*a*), said profile lists (8) having slotted tracks (10), at least one of which opens transversely to said plane, said tracks (10) engaging and guiding a lower list (7) of the shade at its inclined raising and lowering, the lower list (7) being loaded in the direction of the lowering by at least one coil spring (14) rotatably seated in a housing (13), said housing (13) being slidable in the transversely opening track (10) and connected to the lower list (7), an uncoiled part of the spring extending from the housing (13) in the track (10) downwards to a lower fixing point (15), and the axis of the coiled part of the spring (14) seated in the housing being parallel to the longitudinal direction of the lower list.

* * * * *